US005450990A

United States Patent [19]

Migliorini

[11] Patent Number: 5,450,990

[45] Date of Patent: Sep. 19, 1995

[54] METHOD AND APPARATUS FOR AUTOMATICALLY STRETCHING A TUBULAR KNITTED ARTICLE FITTED OVER A SUPPORT SHAPE

[75] Inventor: Pier L. Migliorini, Arezzo, Italy

[73] Assignee: Solis S.R.L., Tavarnuzze, Italy

[21] Appl. No.: 192,674

[22] Filed: Feb. 7, 1994

[30] Foreign Application Priority Data

Feb. 9, 1993 [IT] Italy ..... F193/15

[51] Int. Cl.[6] ..... D06C 15/00; D06C 5/00

[52] U.S. Cl. ..... 223/61; 223/75

[58] Field of Search ..... 223/37, 38, 75, 76, 223/61; 38/102.91

[56] References Cited

U.S. PATENT DOCUMENTS

| | | | |
|---|---|---|---|
| 4,611,733 | 9/1986 | Nishikawa et al. | 223/75 |
| 4,643,340 | 2/1987 | Bailey | 223/75 |
| 4,674,663 | 6/1987 | Hurlebaus et al. | 223/75 |
| 5,261,579 | 11/1993 | Propach et al. | 223/75 |

FOREIGN PATENT DOCUMENTS

| | | | |
|---|---|---|---|
| 166594 | 2/1986 | European Pat. Off. | 223/75 |
| 2081321 | 2/1982 | United Kingdom | 223/75 |

*Primary Examiner*—Clifford D. Crowder
*Assistant Examiner*—Bibhu Mohanty
*Attorney, Agent, or Firm*—McGlew and Tuttle

[57] ABSTRACT

Apparatus for automatically stretching a tubular knitted article slipped on a support shape, comprising:—a device for picking up a limited portion of the article (4) fabric in correspondence of a side edge of the shape (5), holding said article and finally releasing it by way of an elastic, flat-nose, normally closed gripper (1);—a pneumatic cylinder (2) having a horizontal axis and its rod fixed to the base of said gripper (1) to allow it to be moved from and to the shape (5); —a cam (3) having double straight profile to operate the activation, that is, the opening and respectively the closing of said gripper (1) in cooperation with two pivots each of which is idly fitted into a corresponding jaw of the gripper (1) so as to result sideway projecting therefrom and thus engaging a relevant profile of the cam (3) during the activation of the gripper (1): the cam (3) being interposed between the gripper (1) activating cylinder (2) and the stocking (4) supporting shape (5);—an abutment element (6) interposed between the head of said gripper (1) and the relevant driving cylinder (2) to limit the operating return stroke of the gripper (1) and open the jaws.

7 Claims, 2 Drawing Sheets

METHOD AND APPARATUS FOR AUTOMATICALLY STRETCHING A TUBULAR KNITTED ARTICLE FITTED OVER A SUPPORT SHAPE

FIELD OF THE INVENTION

The present invention refers to a method and an apparatus for stretching a tubular knitted article, such as a women's stocking, fitted over a support shape.

BACKGROUND OF THE INVENTION

It is known that the stockings discharged from the machines which produce them, are slipped on appropriate shapes so as to cause them to take up a well stretched configuration and are therefore suited for carrying out the successive operations, such as the detection of the garter line, in order to operate the precise alignment of two stockings to be united to form a pantyhose article.

Also known is the fact that at the end of its fitting over the shape, each stocking exhibits a significant number of wrinkles which must be manually eliminated by an operator who performs an operation which is known with the jargon word "pinch": the fabric of the stocking is held between the thumb and forefinger tips of an operator's hand, in correspondence of the stocking portion to be stretched and, afterwards, the thus retained stocking is subjected to a pull, transversally to the support shape, and finally released. In this way, the stocking is caused to stretch on the relevant shape with consequent disappearance of the wrinkles: this operation having to be repeated in the presence of many wrinkles.

However, since this operation is carried out by hand, it requires the presence of at least a skilled operator during each work shift, which implies the rise of the manufacturing cost of the finished product. In addition to this, if the degree of attention by the operator grows tired, the quality of the finished product results markedly impaired.

SUMMARY AND OBJECTS OF THE INVENTION

The main object of the present invention is to eliminate the above drawbacks.

This result has been achieved, according to the invention, by adopting an operating method which implies:

(a) picking up and holding a limited side portion of the fabric of a tubular knitted article slipped on a support shape;

(b) retracting the thus held fabric portion in transverse direction to the longitudinal axis of the shape and over a length sufficient to allow the elastic pulling of the stitches;

(c) releasing the thus retracted fabric portion to allow the elastic return thereof on the relevant support shape under stretched condition.

And as far as the apparatus for carrying out the said method is concerned, it comprises:

gripper means for picking up a limited side portion of a tubular knitted article fitted over a corresponding support shape, that is, in correspondence of a side edge of the shape;

pneumatically-operated means for supporting and driving the gripper means from a retracted stroke-starting position to a forward stroke-ending position in correspondence with the support shape and vice versa, in a direction transverse to the longitudinal axis of the shape;

cam means for activating the withdrawal and respectively the release of the article by the gripper means.

The advantages obtained from the present invention lie essentially in that it is possible to operate the elastic stretching of the knitted fabric of a tubular article and the consequent automatic, quick and extremely accurate elimination of wrinkles which usually appear during the fitting thereof over the shape; that it is possible to preset and operate the elastic stretching of the article fabric in relation to the material of which it is made up; that it is possible to increase the production rate and thus reducing significantly the manufacturing cost of the tubular knitted articles; that it is possible to easily associate an apparatus according to the invention to the already existing machines for the manufacturing of tubular knitted articles; that such an apparatus is of simple construction, economical and reliable also after a prolonged working period.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DETAILED DESCRIPTION OF THE PREFERRED EMBODIMENT

Figure 1A:
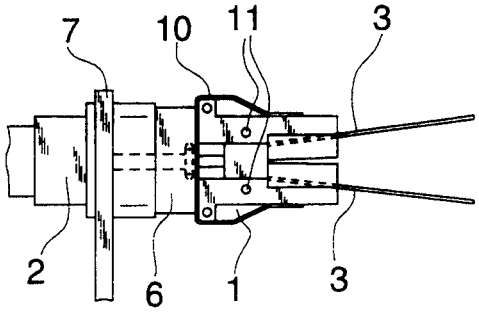
FIG. 1A shows schematically a side view of an apparatus according to the invention, under inoperative condition.
Figure 1B:
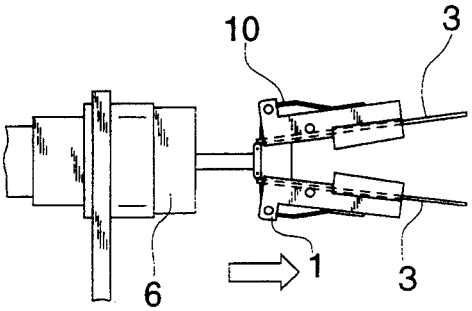
FIG. 1B shows the apparatus of FIG. 1A in the advancement step with the gripper being open to pick up a women's stocking.
Figure 1C:
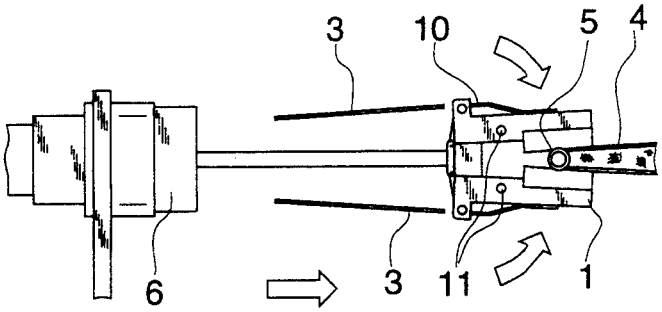
FIG. 1C shows the apparatus of FIG. 1A as it seizes a side portion of the stocking.
Figure 1D:
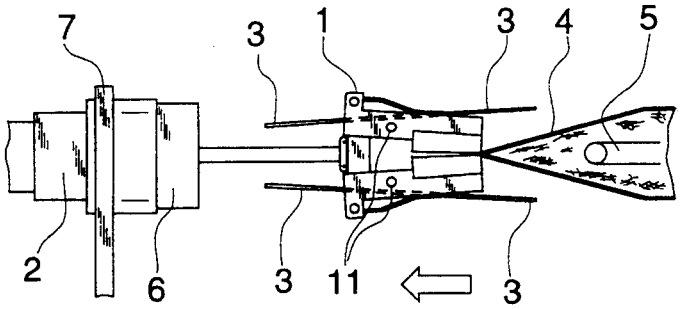
FIG. 1D shows the apparatus of FIG. 1A in its return stroke while stretching the stocking.
Figure 1E:
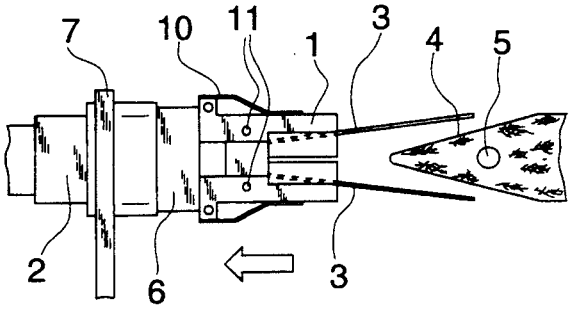
FIG. 1E shows the apparatus of FIG. 1D upon the end of stroke of the gripper with release of the stocking.
Figure 2A:
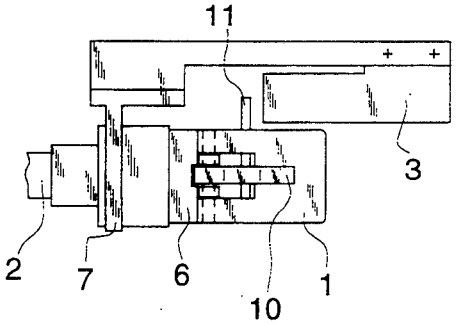
FIG. 2A shows the plan view of the apparatus of FIG. 1A.
Figure 2B:
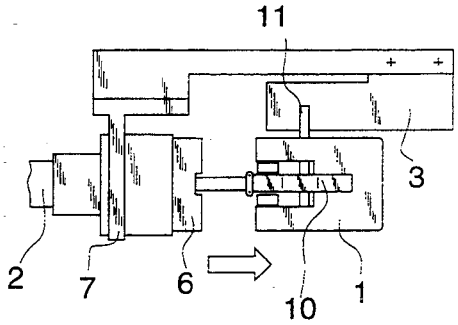
FIG. 2B shows the plan view of the apparatus of FIG. 1B.
Figure 2C:
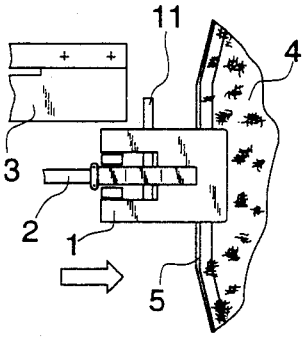
FIG. 2C shows the plan view of the apparatus of FIG. 1C.
Figure 2D:
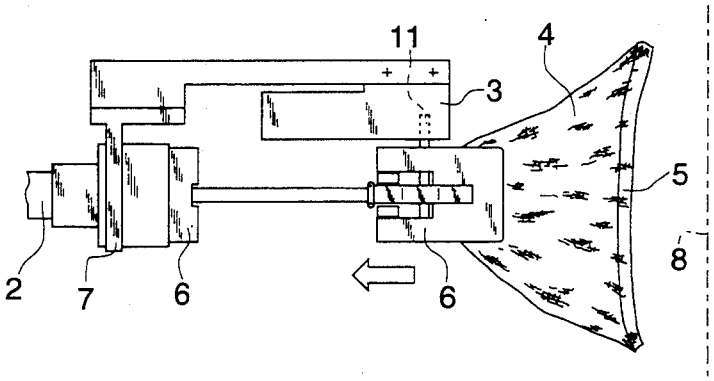
FIG. 2D shows the plan view of the apparatus of FIG. 1D.
Figure 2E:
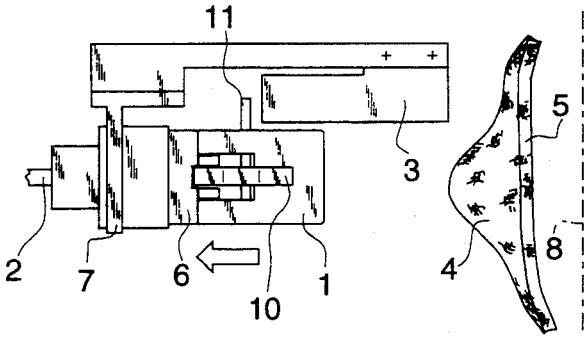
FIG. 2E shows the plan view of the apparatus of FIG. 1E.

Reduced to its basic structure, reference being made to the figures of the attached drawings, a method for automatically stretching a stocking fitted over a support shape according to the invention, comprises in sequence the following operating steps:

(a) picking up and holding a limited side portion of the fabric of a stocking (4) slipped on a support shape (5);

(b) retracting the thus held fabric portion in transverse direction to the longitudinal axis (8) of the shape (5) and over a length sufficient to allow the elastic stretching of the stitches;

(c) releasing the thus retracted fabric portion of the stocking (4) to allow for its elastic return onto the relevant support shape (5) under stretched condition.

As far as the apparatus for carrying out the method is concerned, it comprises:

an elastic, flat-nose, normally closed gripper means (1) which is intended for picking up a limited side portion of the fabric of the stocking (4) in correspondence of a side edge of the shape (5), retaining it and finally releasing it;

movement means including a pneumatic cylinder (2) with a horizontal axis orthogonal to the axis (8) of the shape (5) supporting the stocking (4) and with its rod fixed to the base of said gripper (1) to allow the latter to be moved from and towards the shape (5): the body of the cylinder (2) being connected to a fixed support element (7);

a cam means (3) for activating the opening and respectively the closing of said gripper (1), in cooperation with two pivots or pins (11) each of which is idly fitted into a corresponding jaw of the gripper (1) so as to sideways therefrom and thus engaging a correspondent profile of the cam (3) during the activation of the gripper (1): the cam (3) being interposed between the gripper (1) activating cylinder (2) and the stocking (4) supporting shape (5).

Advantageously, according to the invention, an abutment element or stop means (6) is interposed between the head of the gripper (1) and the relevant driving cylinder (2) so as to limit the operating return stroke of the gripper (1) and exert a thrust on the back of each jaws able to produce an opening moment and the release of the stocking (4).

Advantageously, according to the invention, an elastic lamina (10) is fitted longitudinally astride the two jaws of the gripper (1) so as to allow the closing thereof under inoperative conditions.

The operation of the above described apparatus is as follows.

Upon activation of the cylinder (2), the gripper (1) is made to advance towards the stocking (4) supporting shape (5). During such travel, each pivot (1) slides onto the relevant profile of the cam (3) thereby causing the jaws of the gripper (1) to move away from each other and cause the gripper to open up. At the end of the advancement travel of the gripper (1) towards the shape (5), the pivots (11) do not result in contact with the cam (3) any longer, and, accordingly, the gripper (1) closes and seizes the portion of stocking (4) which becomes clamped between its jaws. Afterwards, the withdrawal of the cylinder (2) and, consequently, the reversal of the travel of gripper (1) with the stocking (4) thus seized, is operated. During the return stroke of the gripper (1) towards its initial position, each pivot (11) results in contact with the inner face of the corresponding profile of the cam (3) and is subjected to a thrust which produces a closing moment of the gripper (1), in cooperation with the lamina (10). At the end of the stroke, the pivots (11) result outside and beyond the cam (3). In this way, each jaw of the gripper (1) receives a thrust by the element (6) so as to cause the opening of the gripper (1) and the release of the stocking (4). The pulling of the thus operated stocking (4) has the effect of stretching the stitches of the fabric and eliminating the pre-existent wrinkles.

Practically, the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

I claim:

1. An apparatus for removing wrinkles in tubular articles fitted over a support shape, the apparatus comprising:

gripper means for clamping onto and releasing a portion of the tubular article at a radial side of the tubular article;

movement means for moving said gripper means toward and away from the support shape in a radial direction of the tubular article which is substantially perpendicular to a longitudinal axis of the tubular article, said moving being of a distance to stretch the tubular article;

cam means positioned between said movement means and the support shape, and for opening and closing said gripper means as said gripper means moves toward and away from the support shape, said gripper means including two profiles which symmetrically diverge apart from each other from said movement means to said gripper means, said gripper means also including two jaws, each jaw including a pin engaging with one of said two profiles during movement of said gripper means toward the support shape for moving said two jaws apart;

stop means for stopping movement of said gripper means away from the support shape and for interacting with said gripper means to release the portion of the tubular article when the movement of the gripper means away from the support shape has been stopped.

2. An apparatus in accordance with claim 1, wherein:

said gripper means is flat nosed, elastic and normally closed;

said profiles are substantially straight.

3. An apparatus in accordance with claim 1, wherein:

said movement means includes a pneumatic cylinder with a longitudinal axis substantially perpendicular to said longitudinal axis of the tubular article, a body of said pneumatic cylinder being connected to a fixed support element, a rod of said pneumatic cylinder being fixed to a base of said gripper means.

4. An apparatus in accordance with claim 3, wherein:

said stop means includes an abutment element positioned between said pneumatic cylinder and a head of said gripper means.

5. An apparatus in accordance with claim 1, wherein:

said gripper means includes elastic means for biasing said jaws toward each other.

6. An apparatus for removing wrinkles in tubular articles fitted over a support shape, the apparatus comprising:

gripper means for clamping onto and releasing a portion of the tubular article at a radial side of the tubular article, said gripper means including jaws positionable around the support shape and attachable to the portion of the tubular article;

movement means for moving said gripper means toward and away from the support shape in a radial direction of the tubular article which is substantially perpendicular to a longitudinal axis of the tubular article, said moving being of a distance to stretch the tubular article and remove wrinkles in the tubular article;

cam means positioned between said movement means and the support shape, and for opening and closing said gripper means as said gripper means moves toward and away from the support shape, and for closing said gripper means when said gripper means is positioned at the support shape, said cam means including two substantially straight profiles which symmetrically diverge apart from each other with respect to distance from said movement means to said gripper means, said cam means also including a pin positioned on each of said jaws of said gripper means, each of said pins sliding along a respective one of said profiles during movement toward the support shape to open said jaws of said gripper means;

stop means for contacting said gripper means to stop movement of said gripper means away from the support shape and to open said jaws to release the portion of the tubular article and cause the tubular article to retract to the support shape without wrinkles.

7. An apparatus for removing wrinkles in tubular articles fitted over a support shape, the apparatus comprising:

gripper means for clamping onto and releasing a portion of the tubular article at a radial side of the tubular article, said gripper means being flat nosed, elastic and normally closed;

movement means for moving said gripper means toward and away from the support shape in a radial direction of the tubular article which is substantially perpendicular to a longitudinal axis of the tubular article, said moving being of a distance to stretch the tubular article;

cam means positioned between said movement means and the support shape, and for opening and closing said gripper means as said gripper means moves toward and away from the support shape, said gripper means including two substantially straight profiles which symmetrically diverge apart from each other from said movement means to said gripper means;

stop means for stopping movement of said gripper means away from the support shape and for interacting with said gripper means to release the portion of the tubular article when the movement of the gripper means away from the support shape has been stopped.

* * * * *

UNITED STATES PATENT AND TRADEMARK OFFICE

CERTIFICATE OF CORRECTION

PATENT NO. : 5,450,990

DATED : September 19, 1995

INVENTOR(S) : Pier Lorenzo Migliorini

It is certified that error appears in the above-indentified patent and that said Letters Patent is hereby corrected as shown below:

Title page, item [75] Inventor: should read--Pier Lorenzo Migliorini, Arezzo, Italy--.

Signed and Sealed this

Second Day of January, 1996

*Attest:*

*Attesting Officer*

BRUCE LEHMAN

*Commissioner of Patents and Trademarks*